United States Patent [19]

Leu

[11] Patent Number: 4,597,541

[45] Date of Patent: Jul. 1, 1986

[54] APPARATUS FOR UNWINDING PRINTED PRODUCTS WOUND UP IN AN IMBRICATED FORMATION

[75] Inventor: Willy Leu, Pfäffikon, Switzerland

[73] Assignee: Ferag AG, Hinwil, Switzerland

[21] Appl. No.: 665,663

[22] Filed: Oct. 29, 1984

[30] Foreign Application Priority Data

Nov. 7, 1983 [CH] Switzerland ..... 5985/83

[51] Int. Cl.[4] ..... B65H 29/16; B65H 20/28; B65B 63/00

[52] U.S. Cl. ..... 242/55; 53/430; 414/29; 242/59; 242/67.3 R; 242/76

[58] Field of Search ..... 53/430, 118; 242/67.1, 242/67.3, 59, 55.2, 55, 76; 271/151, 202, 216, 303, 37, 38; 270/52, 54, 56; 198/347, 423, 461, 462, 778; 414/29, 31, 40, 129, 130, 32, 77, 79, 81, 93, 104

[56] References Cited

U.S. PATENT DOCUMENTS

| | | | |
|---|---|---|---|
| 1,346,356 | 7/1920 | Wenderhold | 242/76 |
| 4,147,247 | 4/1979 | Clarke | 198/347 |
| 4,438,618 | 3/1984 | Honegger | 53/118 X |
| 4,494,359 | 1/1985 | Honegger | 53/118 X |

FOREIGN PATENT DOCUMENTS

| | | | |
|---|---|---|---|
| 54735 | 10/1981 | European Pat. Off. | 242/59 |
| 291531 | 6/1915 | Fed. Rep. of Germany | 242/67.3 R |
| 104850 | 6/1983 | Japan | 271/151 |
| 559691 | 3/1975 | Switzerland | 242/59 |

*Primary Examiner*—Donald Watkins

*Attorney, Agent, or Firm*—Werner W. Kleeman

[57] ABSTRACT

The printed products leaving the product coil or wound package are delivered to an inlet of a conveying channel adjacent to a product transfer or release location of the wound package. A conveying channel is formed by two effectively conveying runs of two belt conveyors. In a section of this conveying channel following this inlet the unwound imbricated formation is inverted. The imbricated formation is subsequently conveyed toward an outlet of the conveying channel where it is transferred to a discharge conveyor. Both belt conveyors are arranged in a pivotable frame construction which is held in contact or coacting relationship with the product coil or wound package by a contact or pressing mechanism. The design of the conveyor arrangement formed by the two belt conveyors permits a compact construction and a free choice of the route of the conveying channel.

22 Claims, 2 Drawing Figures

1
2
2a
3
4
4a
5
6
7
8
9
10
10a
11
12
13
14
15
16
17
18
19
19a
19b
20
21
22
23
24
24a
24b
26
27
28
29
30
32
33
34
34a
35
36
50
51
A
B
C
D
S
S'

APPARATUS FOR UNWINDING PRINTED PRODUCTS WOUND UP IN AN IMBRICATED FORMATION

CROSS-REFERENCE TO RELATED CASE

This application is related to the commonly assigned, copending U.S. application Ser. No. 06/665,664, filed Oct. 29, 1984, entitled APPARATUS FOR WINDING UP PRINTED PRODUCTS ARRIVING IN IMBRICATED FORMATION, and listing as the Inventor SAMUEL STAUB.

BACKGROUND OF THE INVENTION

The present invention broadly relates to an improved construction of apparatus for unwinding printed products wound up in an imbricated formation upon a winding mandrel or core conjointly with a winding strap.

In its more specific aspects the invention pertains to a new and improved construction of an apparatus for unwinding printed products previously wound up in imbricated formation upon a winding mandrel or core conjointly with a winding strap and having a bearing or support arrangement for freely rotatably journalling one winding mandrel at a time, a rotatably journalled and drivable winding strap take-up roll for winding the winding strap unwound from the product coil or wound package, and a pivotably journalled continuous conveyor capable of being positioned in coacting relationship with the winding mandrel, respectively with the product coil or wound package thereon, for conveying the unwound imbricated product formation away.

In other words, the present invention relates to an apparatus for unwinding essentially flat products, such as printed products and the like, that have been previously wound up in imbricated formation on a winding mandrel or core conjointly with a winding strap to form a product package, which apparatus comprises bearing or support means for freely rotatably journalling one winding mandrel at a time, a rotatably journalled and drivable winding strap take-up roll for winding up the winding strap unwound from the product package, and a pivotably journalled continuous conveyor having an effectively conveying run and capable of being positioned in coacting relationship with the winding mandrel for transporting the unwound imbricated product formation away.

In an unwinding apparatus of this type which is known from the U.S. Pat. No. 4,438,618, granted Mar. 27, 1984, the continuous conveyor, which is constructed as a belt conveyor pivotably journalled at its inner end, serves as a support for the winding strap and the printed products wound up with this winding strap. In other words, the belt conveyor extends beneath the imbricated formation. With decreasing coil diameter, the angle of attack of the belt conveyor varies. The slope angle of the belt conveyor must be prevented from becoming too great, since there is otherwise a danger of the printed products sliding. This danger could be countered by employing a belt conveyor with a long conveying path in which the distance between the pivot point of the conveyor and the product coil or wound package is chosen to be relatively great. Such a construction has, however, the disadvantage of a correspondingly greater constructional length. The conveying path defined by this belt conveyor can also not readily be given a shape or course which appreciably departs from a straight line.

SUMMARY OF THE INVENTION

Therefore, with the foregoing in mind, it is a primary object of the present invention to provide a new and improved construction of an apparatus for unwinding essentially flat products, such as printed products and the like, that have been previously wound up in imbricated formation on a winding mandrel or core conjointly with a winding strap to form a product coil or wound package, which unwinding apparatus does not exhibit the aforementioned drawbacks and shortcomings of the prior art constructions.

Another and more specific object of the present invention aims at providing a new and improved unwinding apparatus of the previously mentioned type which permits an impeccable removal of the unwound printed products and which permits as great as possible degree of freedom in design with as simple and space-saving a construction as possible.

Yet a further significant object of the present invention aims at providing a new and improved construction of an unwinding apparatus of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the unwinding apparatus of the present invention for unwinding essentially flat products, such as printed products and the like, that have been previously wound up in imbricated formation on a winding mandrel conjointly with a winding strap to form a product coil or wound package is manifested by the features that, the continuous conveyor is arranged such that its effectively conveying run or path extends completely on a side of the winding strap which faced the winding mandrel before unwinding and this effectively conveying run or path is capable of being rendered operative or coactive with the imbricated formation on a face or side of the unwinding imbricated formation which previously faced the winding mandrel.

Since the unwound imbricated formation is now guided by the continuous conveyor on that side which was facing the winding mandrel in the product coil or wound package, the possibility exists of freely selecting the path or course of the conveying path within wide limits without the danger of a shifting of the position of the printed products within the imbricated formation. This opens the possibility of a compact construction since the conveying path can, for instance, even climb relatively steeply.

Furthermore, a deflection station for inverting the imbricated formation can be provided in the conveying path. If this deflection station or location is selected adjacent to the transfer location or position of the printed products from the product coil or wound package, then the inversion and discharge of the unwound printed products can be effected along a relatively short conveying path which permits a space-saving construction. This advantage of a short construction or structural length of the equipment is especially important when the transfer location is arranged on the underside of the product coil or wound package and the inner end of the continuous conveyor is arranged as closely as possible to the circumference of the full or completed product coil or wound package.

Particular advantages arise when two continuous conveyors, preferably constructed as belt conveyors, are provided and which form a conveying channel with defined inlet and outlet in which the printed products are clamped.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
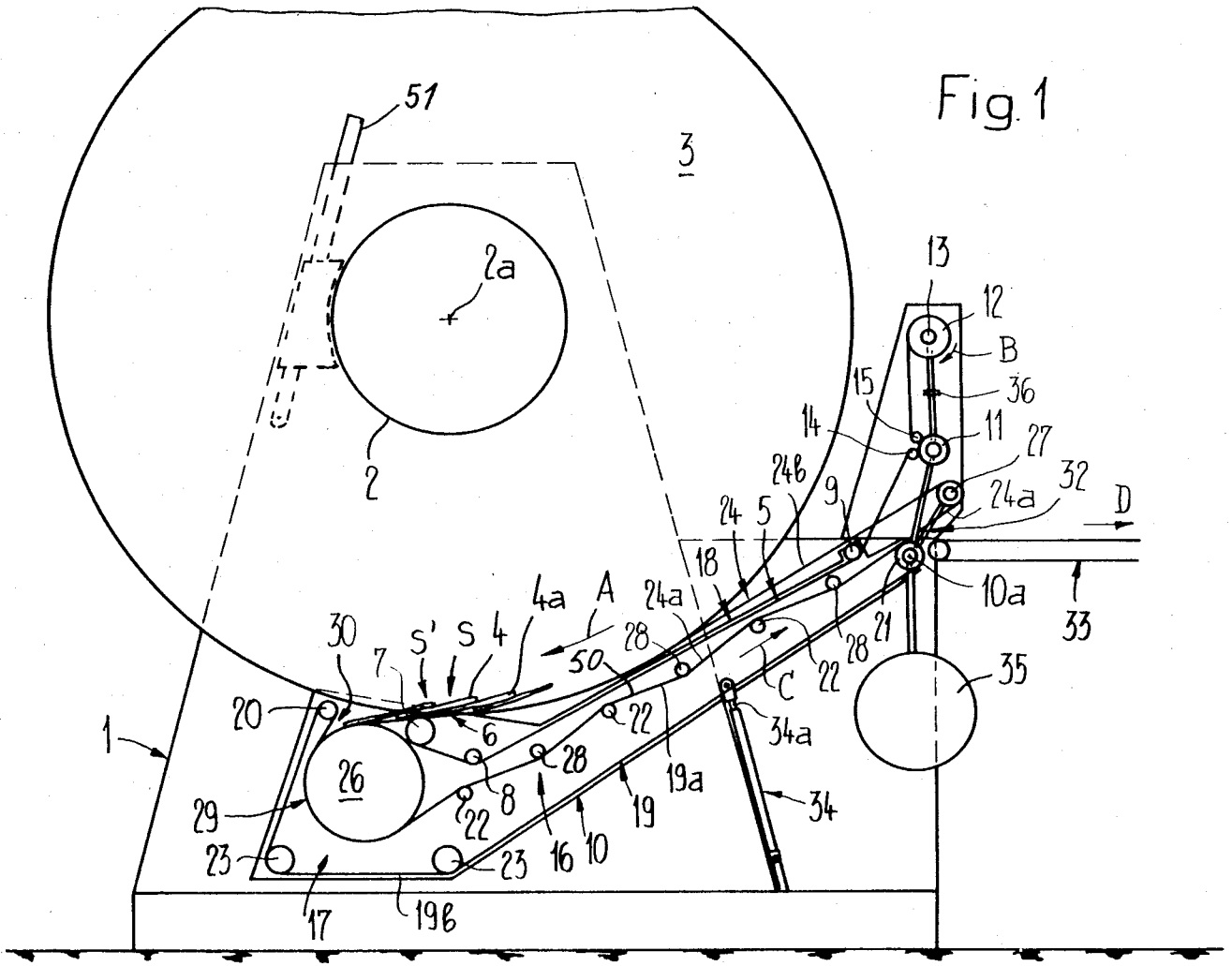
FIG. 1 schematically shows an unwinding apparatus at the beginning of the unwinding procedure.

Describing now the drawings, it is to be understood that to simplify the showing thereof only enough of the structure of the apparatus for unwinding essentially flat products, such as printed products and the like, that have been previously wound up in imbricated formation on a winding mandrel or core conjointly with a winding strap or band to form a product coil or wound package has been illustrated therein as is needed to enable one skilled in the art to readily understand the underlying principles and concepts of this invention. Turning now specifically to FIG. 1 of the drawings, the unwinding apparatus illustrated therein, by way of example and not limitation, will be seen to comprise a support frame 1 which is provided with suitable conventional bearings, not particularly shown, for accommodating a winding mandrel or core 2. These bearings are constructed such that the winding mandrel 2 can readily be inserted into the bearings and again lifted out of them. The winding mandrel 2 is journalled to be freely rotatable about its axis of rotation 2*a*. The winding mandrel 2 carries a product coil or wound package 3 whose coil layers are formed for instance by printed products 4 arranged in an imbricated formation S. The individual coil layers are separated from one another by the winding strap or band 5 maintained under tension and which defines a partitioning strap or band. This winding strap 5 extends along that side of the imbricated formation S which is most remote from the winding mandrel 2 in the product coil or wound package.

The winding strap 5 is conducted beyond or downstream of the transfer location or position 6 at which the winding strap 5 and also the printed products 4 run off the product coil or wound package 3 when unwinding and thence over a deflection roll 7 as well as over guide rollers 8 and 9. Both the deflection roll 7 and the guide rollers 8 and 9 are journalled in a frame construction 10 which is appropriately journalled in the frame 1 to pivot about an axis 10*a*. The pivot axis 10*a* of the frame construction 10 extends substantially parallel to the axis of rotation 2*a* of the winding mandrel 2. The winding strap 5 runs from the guide roller 9 over a conveyor or drive roll 11 and then to a winding strap take-up roll 12 which is arranged upon a shaft 13 journalled in the frame 1. Diverting rolls 14 and 15 ensure that the winding strap 5 wraps around the conveyor roll 11 by a sufficient amount.

A pivotable conveying arrangement generally designated with the reference numeral 16 is provided for transporting away or discharging the printed products 4 emanating from the product coil or wound package 3 when unwinding. This pivotable conveying arrangement 16 comprises two pivotably arranged belt conveyors 17 and 18. A conveyor belt 19 of the pivotably arranged first belt conveyor 17 which, for instance, may comprise a plurality of straps or sub-belts arranged in mutually spaced adjacent relationship, is conducted over an arcurately movable outer deflection roll 20 arranged at an outer end thereof as well as around a stationarily arranged inner deflection roll 21 and arcuately movable therewith. The outer deflection roll 20, which is journalled in the frame construction 10, is situated in immediate proximity of the circumference of the product coil or wound package 3 and adjacent to the transfer location or position 6. An effectively conveying run 19*a* of this conveyor belt 19 is conducted over guide rollers 22 which are also journalled in the pivotable frame construction 10. A return conveyor belt run 19*b* runs over guide rollers 23 journalled in the pivotable frame construction 10. The stationarily arranged inner deflection roll 21 of the pivotably arranged an first belt conveyor 17 is stationarily journalled in the frame 1 and at inner end of the pivotable frame construction 10.

The pivotally arranged second belt conveyor 18 also comprises a conveyor belt 24 which, just as the conveyor belt 19, may comprise straps or sub-belts arranged in mutually spaced adjacent relationship. The conveyor belt 24 is conducted over an arcuately movable outer deflection roll 26 and a stationarily arranged inner deflection roll 27. The arcuately movable outer deflection roll 26 is, just as the guide rollers 28 for the effectively conveying run 24*a* of the conveyor belt 24, journalled in the pivotable frame construction 10 at an outer end thereof, while the stationarily arranged inner deflection roll 27 is stationarily journalled in the frame 1 and at an inner end of the pivotable frame 10. The arcuately movable outer deflection roll 26 of the pivotably arranged second belt conveyor 18 is constructed as a deflection drum for the unwound imbricated formation S and therefore forms part of a turning or inverting device which defines a deflection station or location 29.

The effectively conveying run 19*a* of the other conveyor belt 19 is also conducted over this arcuately movable outer deflection roll or drum 26 after being deflected over the arcuately movable outer deflection roll 20. The conveyor belt run 19*a* running onto the arcuately movable outer deflection roll or drum 26 forms together with the effectively conveying run 24*a* of the other conveyor belt 24 also conducted over the arcuately movable outer deflection roll or drum 26 an entry or inlet 30 to a conveying channel or passage 50 which is formed by the two effectively conveying runs 19*a* and 24*a* of the conveyor belts 19 and 24.

After running off the arcuately movable outer deflection roll or drum 26, both runs 19*a* and 24*a* run together over the guide rollers 22 and 28, which are shifted in relation to one another such that a zig-zag path or guidance of these two runs is achieved. By this measure an impeccable clamping of the discharged outfed printed products is ensured. An outlet or exit 32 of the mentioned conveying channel 50 is situated at the pivotably arranged end of the first belt conveyor 17, i.e. in the region of its stationarily arranged inner deflection roll 21. A discharge or outfeed conveyor 33 in the form of a belt conveyor follows this outlet 32 of the conveying channel 50.

A contact or pressing mechanism 34 of conventional type engages the pivotable frame construction 10 and is supported on the frame 1. This contact mechanism 34, constructed for instance as a gas pressure spring, comprises a pressurized piston rod 34*a* which is hingedly connected with the pivotable frame construction 10. The pivotable frame construction 10 and with it also the pivotable conveying arrangement 16 is maintained in contact with or in coacting relationship to the product coil or wound package 3, respectively with the winding mandrel 2, by this contact mechanism 34. As can be seen from the Figures, the return run 24*b* of the belt conveyor 24 is brought into contact with the circumference of the product coil or wound package 3, respectively of the winding mandrel 2.

A source of driving power is mounted on the frame 1 which, in the exemplary embodiment, is a drive motor 35 (cf. FIG. 1). This drive motor 35 drives the arcuately movable inner deflection and drive roll 21 of the pivotably arranged first belt conveyor 17. This arcuately movable inner deflection roll 21 is in driving connection with the arcuately movable inner deflection and drive roll 27 of the other, pivotably arranged, second belt conveyor 18, on the one hand, and with the conveyor roll 11 for the winding strap 5, on the other hand. The winding strap take-up roll 12 is driven in the direction of the arrow B by this drive or conveyor roll 11 through a slip or release coupling 36.

The unwinding of the printed products 4 from the product coil or wound package 3 proceeds as follows:

After inserting the winding mandrel 2 carrying a previously wound product coil or wound package 3 into the bearing in the support frame 1, the free end of the winding strap or band 5 is connected with the winding strap take-up roll 12 or, alternatively, a winding strap take-up roll 12 delivered with the winding mandrel 2 is set on the shaft 13. The conveying arrangement 16 is brought into coacting relationship or into proximity with, preferably pressed against, the product coil or wound package 3 by means of the contact mechanism 34, so that the deflection rolls 7 and 20 and also the inlet 30 of the conveying channel 50 are arranged in proximity to the circumference of the product coil or wound package 3. Then the drive motor 35 is switched on and drives the stationarily arranged inner or drive rolls 21 and 27 for the pivotably arranged first and second belt conveyors 16 and 17 as well as the conveyor or drive roll 11 and the winding strap take-up roll 12.

Figure 2:
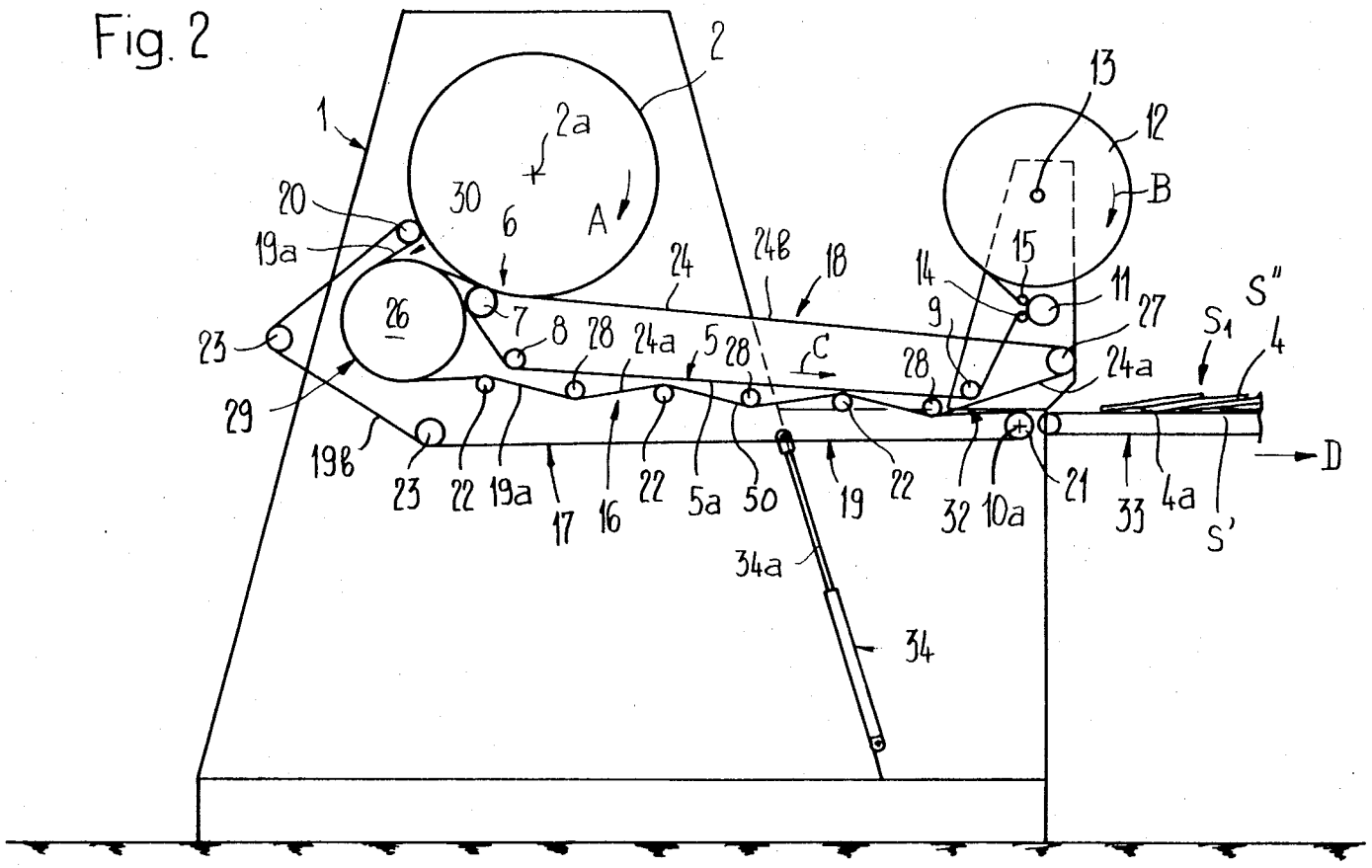
FIG. 2 schematically shows the unwinding apparatus at the end of the unwinding procedure.

Due to the tension exerted by the conveyor or drive roll 11 on the winding strap 5, the freely rotatably journalled winding mandrel 2, together with the product coil or wound package 3, is set into rotation in the direction of the arrow A. The winding mandrel 2 is slightly braked by a suitable conventional braking device 51 in order to maintain the winding strap 5 taut. The printed products 4 begin to separate from the product coil or wound package 3 at the transfer location or position 6 and are subsequently conducted to the inlet 30 of the conveying channel 50 by the run 24*b* of the conveyor belt 24. The winding band or strap 5 or the like running off the product coil or wound package 3 separates from the underside of the unwound printed products 4 when running around the deflection roll 7. The printed products 4 are inverted in a section of the conveying channel 50 following the inlet 30, i.e. at the inverting point or location 29, such that the side S′ of the imbricated formation S previously facing the winding mandrel 2 in the product coil or wound package 3 now lies on the underside. The unwound printed products 4 are subsequently conducted in the direction of the arrow C to the outlet 32 of the conveying channel 50 where they are transferred to the belt conveyor 33 which discharges or transports the printed products 4 away in the direction of the arrow D. As shown in FIG. 2, the trailing edges 4*a* of the printed products 4 in the discharged imbricated formation $S_1$ are situated upon the underside S′ of the imbricated formation $S_1$, whereas these trailing edges 4*a* were arranged on the upper side S″ of the imbricated formation S running off the product coil or wound package 3 (cf. FIG. 2) before being inverted at the inverting or deflection location 29.

At the end of the unwinding procedure, the now empty winding mandrel 2 and the full winding strap take-up roll 12 (cf. FIG. 2) can be removed and replaced by a new winding mandrel 2 with a product coil or wound package 3 and a new winding strap take-up roll 12.

Since, as already mentioned, the pivotable frame construction 10, together with the pivotable conveying or conveyor arrangement 16, is held in close proximity to, preferably in contact with, the progressively diminishing product coil or wound package 3 during the entire unwinding procedure by the contact or pressing mechanism 34, the pivotable frame construction 10 is pivoted from its lower position shown in FIG. 1 into its upper final position shown in FIG. 2 in proportion to the reduction of the diameter of the product coil or wound package 3 as it is being unwound. During this pivoting motion of the pivotable frame construction 10 and the pivotable conveying arrangement 16, the transfer location or position 6 arranged adjacent to the deflection roll 7 for the winding strap 5 as well as the inlet 30 both remain exactly defined. In other words, the position of this transfer location or point 6 and of the inlet 30 in relation to the two pivotably arranged first and second belt conveyors 17 and 18 varies only insignificantly or not at all, which means that predetermined conditions prevail during the entire unwinding procedure.

If, as in the illustrated exemplary embodiment, the transfer location 6 is selected to be on the underside of the product coil or wound package 3 and therefore beneath the winding mandrel 2, then the printed products 4 can contribute to an impeccable separation from the product coil or wound package 3 by their own weight. Furthermore, arranging the transfer location 6 at the underside of the product coil or wound package 3 has the advantage that space is required in height but not in width for taking over the separated printed products 4, as can readily be seen in the figures. If, additionally, as in the illustrated exemplary embodiment, the outlet 32 of the conveying channel 50 is selected as close as possible to the still full product coil or wound package 3, then the required construction length can be reduced to a minimum dimension.

Since the pivotably arranged first belt conveyor 17 extends completely on that side 5*a* of the winding strap 5 which was previously facing the winding mandrel 2 in the product coil or wound package 3 and this pivotably arranged first belt conveyor 17 therefore supports the printed products 4 on their side S′ which was previously facing the winding mandrel 2, the conveying path for the printed products 4 to be discharged or conveyed away can be given that path or course which is prerequisite for a compact construction and which need not necessarily be straight. In particular, it is possible, as shown, to provide a deflection or inverting location 29 for inverting the unwound printed products 4 shortly after the transfer or separating location 6. This pivotably arranged first belt conveyor 17 permits, together with the other, pivotably arranged, second belt conveyor 18, constructing the conveying path with a certain slope without the danger of sliding and therefore of a change in position of the printed products 4 within the imbricated formation S.

It will be understood that the inversion of the unwound imbricated formation S can also be forgone. In such case, the pivotable conveying arrangement 16 would have to be designed differently.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for unwinding substantially flat products, such as printed products and the like, that have been previously wound up in imbricated formation on a winding mandrel conjointly with a winding strap in the form of a wound package, comprising:

support means for freely rotatably journalling one winding mandrel at a time;

a rotatably journalled and drivable winding strap take-up roll for winding up said winding strap unwound from said wound package;

a pivotably journalled continuous conveyor having an effectively conveying run and coacting with said winding mandrel and the products wound thereon for transporting said unwound products away as an imbricated formation;

said winding strap having a side which previously faced said winding mandrel before unwinding said wound package;

said continuous conveyor being arranged such that said effectively conveying run extends completely on said side of said winding strap;

said unwinding imbricated formation having a side which previously faced said winding mandrel within said wound package; and said effectively conveying run operatively coacting with said side of the unwinding imbricated formation.

2. The apparatus as defined in claim 1, wherein:

said pivotably journalled continuous conveyor contacts the wound product package during unwinding thereof.

3. The apparatus as defined in claim 1, wherein:

said continuous conveyor comprises a belt conveyor.

4. The apparatus as defined in claim 1, wherein:

said continuous conveyor has an arcuately movable outer end and defines a conveying path; and means defining a deflection location located in said conveying path subsequent to said arcuately movable outer end for inverting said unwound imbricated formation.

5. The apparatus as defined in claim 4, further including:

an arcuately movable outer deflection roll provided at said arcuately movable outer end of said continuous conveyor;

said support means defining an axis of rotation for the winding mandrel;

a pivotable frame construction pivotable about a further axis extending substantially parallel to said axis of rotation; and said arcuately movable outer deflection roll being journalled in said frame construction.

6. The apparatus as defined in claim 5, wherein:

said continuous conveyor comprises a belt conveyor;

a plurality of guide rollers provided for said belt conveyor; and said plurality of guide rollers being journalled in said pivotable frame construction.

7. The apparatus as defined in claim 5, wherein:

said continuous conveyor has a stationarily arranged inner end; and a stationarily arranged inner deflection roll stationarily arranged at said stationarily arranged inner end.

8. The apparatus as defined in claim 7, wherein:

said stationarily arranged inner deflection roll comprises a drive roll of the continuous conveyor.

9. The apparatus as defined in claim 7, wherein:

said stationarily arranged inner deflection roll has an axis of rotation; and said pivotable frame construction being pivotable about said axis of rotation of said stationarily arranged inner deflection roll.

10. The apparatus as defined in claim 5, further including:

an arcuately movable deflection drum journalled in said pivotable frame construction; and said effectively conveying run being conducted beyond said arcuately movable outer deflection roll and over said arcuately movable deflection drum.

11. The apparatus as defined in claim 1, further including:

a further continuous conveyor; and said further continuous conveyor and said continuous conveyor conjointly forming a conveying channel therebetween.

12. The apparatus as defined in claim 11, wherein:

said further continuous conveyor comprises a belt conveyor.

13. The apparatus as defined in claim 11, wherein:

said conveying channel has an inlet;

said products have a transfer location with respect to said product package; and said inlet being arranged adjacent to said transfer location.

14. The apparatus as defined in claim 13, wherein:

said inlet is arranged beneath said product package.

15. The apparatus as defined in claim 12, wherein:

said further continuous conveyor has a stationarily arranged inner end;

said belt conveyor of said further continuous conveyor comprising a stationarily arranged inner deflection roll arranged at said stationarily arranged inner end and at least one conveyor belt trained about an arcuately movable deflection drum; and said at least one conveyor belt being conducted over said arcuately movable deflection drum and over said stationarily arranged inner deflection roll.

16. The apparatus as defined in claim 15, further including:

a plurality of guide rollers;

said plurality of guide rollers being journalled in said pivotable frame construction; and said at least one conveyor belt being conducted over said plurality of guide rollers.

17. The apparatus as defined in claim 15, wherein:

said stationarily arranged inner deflection roll is stationarily arranged.

18. The apparatus as defined in claim 17, wherein:

said stationarily arranged inner deflection roll comprises a drive roll.

19. The apparatus as defined in claim 5, further including:

a deflection roll for the winding strap; and said winding strap being conducted over said deflection roll after unwinding from said product package for separation of said winding strap from said imbricated formation.

20. The apparatus as defined in claim 19, wherein:

said deflection roll is journalled in said frame construction.

21. The apparatus as defined in claim 1, further including:

a release coupling;

a driven conveyor roll drivingly connected to said winding strap take-up roll by said release coupling; and said unwound winding strap being conducted over said driven conveyor roll.

22. An apparatus for unwinding substantially flat products, such as printed products and the like, that have been previously wound up in imbricated formation on a winding mandrel conjointly with a winding strap in the form of a wound package, comprising:

support means for removably and rotatably journalling a winding mandrel supporting a wound package;

a rotatably journalled and drivable winding strap take-up roll for winding up said winding strap unwound from said wound package;

a pivotably journalled continuous conveyor having an effectively conveying run and positioned in close proximity to the wound package supported upon said winding mandrel for transporting away said unwound products;

said winding strap having a side which faces said winding mandrel within said wound package;

said continuous conveyor being arranged such that said effectively conveying run extends on said side of said winding strap;

said unwinding imbricated formation having a side which faces said winding mandrel within said wound package; and said effectively conveying run coacting with said side of said unwinding imbricated formation.

* * * * *

UNITED STATES PATENT AND TRADEMARK OFFICE

CERTIFICATE OF CORRECTION

PATENT NO. : 4,597,541

DATED : July 1, 1986

INVENTOR(S) : WILLY LEU

It is certified that error appears in the above—identified patent and that said Letters Patent is hereby corrected as shown below:

Column 4, line 18, after "the" please insert --pivotable--

Column 4, line 18, after "10" please insert --and arcuately movable therewith--

Column 4, line 28, before the word "first" please delete "an"

Column 4, line 68, after "the" please insert --end of the--

Column 5, line 1, please delete "end of the"

Signed and Sealed this

Thirteenth Day of January, 1987

*Attest:*

DONALD J. QUIGG

*Attesting Officer*

*Commissioner of Patents and Trademarks*